US006368057B1

(12) United States Patent
Takahashi et al.

(10) Patent No.: US 6,368,057 B1
(45) Date of Patent: Apr. 9, 2002

(54) STEAM TURBINE

(75) Inventors: Toru Takahashi; Kenichi Imai; Ryou Oda, all of Yokohama; Yoichi Tsuda, Tokyo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/494,347

(22) Filed: Jan. 31, 2000

(30) Foreign Application Priority Data

Jan. 29, 1999 (JP) ..... 11-023021

(51) Int. Cl.[7] ..... F01D 1/02

(52) U.S. Cl. ..... 415/199.5; 415/200; 415/216.1

(58) Field of Search ..... 415/199.4, 199.5, 415/216.1, 200

(56) References Cited

U.S. PATENT DOCUMENTS 6,074,169 A * 6/2000 Siga et al. ..... 416/241 R
6,203,274 B1 * 3/2001 Kikuchi et al. ..... 415/191

* cited by examiner

*Primary Examiner*—Edward K. Look
*Assistant Examiner*—Ninh Nguyen
(74) *Attorney, Agent, or Firm*—Oblon, Spivak, McClelland, Maier & Neustadt, P.C.

(57) ABSTRACT

A steam turbine includes a turbine high pressure section, a turbine intermediate pressure section and a turbine low pressure section, in which at least two or more of these pressure sections are combined together, and a turbine rotor which is subjected to a gradient thermal treatment at different thermal treating temperatures at respective pressure sections is rotatably supported by bearings and accommodated in a turbine casing, and in a case where an axial distance from a setting position of a turbine movable blade of a final stage of the turbine low pressure section to a setting position of a partition plate disposed at a time when the gradient thermal treatment is performed to each of the pressure sections at different thermal treating temperature is defined as A, a blade length of the turbine movable blade is defined as B, and an axial distance from a prior stage of the final stage of the turbine low pressure section to the setting position of the partition plate is defined as C, the setting position of the partition plate is set in a range of (A/B)≧0.9 and C≧300 mm.

7 Claims, 9 Drawing Sheets

STEAM TURBINE

BACKGROUND OF THE INVENTION

The present invention relates to a steam turbine having a turbine casing in which two or more of turbine pressure sections including a high pressure turbine section, an intermediate pressure turbine section and a low pressure turbine section are combined and accommodated.

In a conventional steam turbine, in order to a increase an output power thereof, a turbine casing thereof is divided into a high pressure turbine casing, an intermediate pressure turbine casing and a low pressure turbine casing, and a turbine rotor (turbine shaft) including a turbine nozzle and a turbine movable blade is accommodated in each of the casings, thereby constituting a high pressure turbine section, an intermediate pressure turbine section and a low pressure turbine section. The conventional steam turbine is operated as a so-called power train in which the shafts of the turbine rotors of the high, intermediate and low pressure turbine sections are connected to one another in a form of a train.

If the high, intermediate and low pressure turbine sections are disposed as the power train, the steam turbine takes a span as long as at least about 30 m although depending upon the output power thereof. Therefore, there has been realized a so-called high-low pressure integrated type turbine or high-intermediate pressure integrated type turbine in which two or more of the high, intermediate and low pressure turbine sections are combined and accommodated in one casing so as to shorten the span.

If the steam turbine is the high-low pressure integrated type turbine or the high-intermediate pressure integrated type turbine, the turbine rotor thereof must inevitably handle many kinds of steams having different temperatures. However, recently, there has been realized a high-low pressure integrated type turbine or a high-intermediate pressure integrated type turbine in which a portion of one turbine rotor exposed to steam having high pressure and high temperature under different thermal treatment conditions is provided with high temperature strength and another portion thereof exposed to steam having relatively low pressure and low temperature is provided with tensile strength and low temperature toughness. Such a high-low pressure integrated type turbine or a high-intermediate pressure integrated type turbine has showed a number of good experience records.

Further, in a recent thermal power plant, there have been realized a number of combined cycle power plants in which steam turbine and exhaust heat recovery means are combined in a gas turbine instead of a conventional power plant.

A steam turbine employed in this combined cycle power plant is used in a condition that as the steam turbine, one having output of 100 MW is selected in view of current state of the gas turbine output of 100 MW, a steam pressure is set to 100 kg/cm$^2$, a steam temperature is set to 500° C., a height of a turbine movable blade of the final stage of the low pressure turbine is set to 36 inches or more in a region of 50 Hz at 3,000 rpm, and the height is set to 33.5 inches or more in a region of 60 Hz at 3,600 rpm. In this case, the steam turbine is formed into a so-called uniaxial type turbine in which a steam turbine shaft is directly connected to the gas turbine. Therefore, a high-low pressure integrated type turbine or a high-intermediate pressure integrated type turbine is employed as the steam turbine, thereby shortening a span between bearings and reducing an installation area.

As described above, in the combined cycle power plant going mainstream in place of the conventional power plant, the number of shafts of the gas turbines directly connected to the steam turbines is set to five or more so that a total output power becomes 1,000 MW or greater, the steam turbine is formed into the high-low pressure integrated type turbine or the high-intermediate-low pressure integrated type turbine, so that an installation area of the five shaft arrangement is further reduced to effectively utilize a site or land.

In a recent thermal power plant, one of the high-low pressure integrated type turbine and the high-intermediate-low pressure integrated type turbine is selected as a steam turbine used in the combined cycle power plant, thereby further reducing the installation area. However, there still exist the following problems:

(1) In a steam turbine provided with one turbine rotor, the turbine rotor includes a high-intermediate-low pressure section or a high-low pressure section, a high-intermediate pressure section is provided with high temperature strength (creep strength) and a low pressure section is provided with high tensile strength and high toughness. Such a steam turbine is already on its way to reaching limitations to simultaneously satisfy the mutually contradictory functions of high temperature strength, the high tensile strength and the like and to further increase such strength. That is, when attempt is made to further increase a volume of a single steam turbine, it is inevitably necessary to increase the temperature of steam and to increase the length of the turbine blade. However, in the case of the turbine rotor including the conventional high-intermediate-low pressure section or the high-low pressure section, it is difficult to sufficiently secure the strength including high temperature strength and vibration strength. For this reason, a countermeasure is required to secure the strength of the turbine rotor to counter the high temperature of steam.

(2) When thermal treating temperatures of the high-intermediate pressure section and the low pressure section are changed from each other so as to provide the high-intermediate section or the high pressure section with high temperature strength and to provide the low pressure section with tensile strength and toughness, a gap is provided between the high-intermediate pressure section and the low pressure section. Moreover, a partition plate is provided in the gap, and temperature gradient thermal treatment is carried out. However, in a case where radius of curvature of a groove bottom (heat groove, hereinafter) of the gap is small, there is a problem that quench crack is generated in the turbine rotor at the time of the temperature gradient thermal treatment.

(3) When the temperature gradient thermal treatment is carried out in a condition that the gap is formed between the high-intermediate pressure section and the low pressure section and the partition plate is provided in the gap, if the steam temperature at a position where the partition plate is disposed is 400° C. or more, the high temperature strength of the high-intermediate pressure section after the thermal treatment is not sufficient and the high temperature toughness is insufficient, being defective and inconvenient.

(4) When the high-intermediate pressure section and the like and the low pressure section are subjected to the temperature gradient thermal treatment, since it is necessary to secure a place where the partition plate is disposed, the turbine rotor is provided with the gap, and this inevitably increases the span of the turbine rotor. Therefore, at a time of securing the position to dispose the partition plate, it is necessary to shorten the span of the turbine rotor to secure the place where the partition plate is disposed.

SUMMARY OF THE INVENTION

The present invention has been accomplished in view of the above circumstances, and it is an object of the present invention to provide a steam turbine capable of sufficiently securing strength of a turbine rotor including a high-intermediate-low pressure section or a high-low pressure section against high temperature of steam and long length of a turbine blade in accordance with increasing of volume of a single device.

This and other objects can be achieved according to the present invention by providing a steam turbine including a turbine high pressure section, a turbine intermediate pressure section and a turbine low pressure section, in which at least two or more of the pressure sections are combined together, and a turbine rotor which is subjected to a gradient thermal treatment at different thermal treating temperatures at respective pressure sections is rotatably supported by bearings and accommodated in a turbine casing, and in the improvement of the steam turbine, in a case where an axial distance from a setting position of a turbine movable blade of a final stage of the turbine low pressure section to a setting position of a partition plate disposed at a time when the gradient thermal treatment is performed to each of the pressure sections at different thermal treating temperature is defined as A, a blade length of the turbine movable blade is defined as B, and an axial distance from a prior stage of the final stage of the turbine low pressure section to the setting position of the partition plate is defined as C, the setting position of the partition plate is set in a range of $(A/B) \geqq 0.9$ and $C \geqq 300$ mm.

In preferred embodiments in the above aspect, a gap of the turbine rotor in which the partition plate is disposed is defined as H and a radius of curvature of a groove bottom of the gap is defined as R, the gap H and the radius R of curvature of the groove bottom are set in ranges of $H \geqq 140$ mm and $R \geqq 70$ mm.

The partition plate is disposed at a position at which a steam temperature is 400° C. or less.

The partition plate is disposed at a position of either one of space regions of a low pressure steam inlet and a low pressure bleeder port of the turbine low pressure section.

In a case where a bearing span of the turbine rotor is defined as L, the bearing span L is set in a range of $L \geqq 5{,}700$ mm.

A blade length of the turbine movable blade in the final stage of the turbine low pressure section is 30 inches or more.

At least one of the turbine sections is supplied with a steam having pressure of 100 kg/cm$^2$ or more and temperature of 500° C.

As described above, according to the steam turbine of the present invention, when the turbine high-intermediate pressure section and the turbine low pressure section, or the turbine high pressure section and the turbine low pressure section of the turbine rotor are subjected to the gradient thermal treatment at different temperatures, a setting position of the final stage of the turbine low pressure section is taken as a reference, a blade length of the turbine movable blade in the final stage, an axial distance from the final stage to the setting position of the partition plate for the gradient thermal treatment, and an axial distance from the second stage from the final stage to the setting position of the partition plate for the gradient thermal treatment are taken into consideration comprehensively to set a proper position of the partition plate for the gradient thermal treatment. Therefore, a high temperature strength can be secured by the turbine high-intermediate pressure section or the turbine high pressure section, high tensile strength and toughness can be secured by the turbine low pressure section. It is therefore possible to sufficiently cope with high temperature tendency of a single device volume and high output tendency.

Furthermore, according to the steam turbine of the present invention, since the bearing span is set to appropriate position so that the rated rotation number of the turbine rotor can be detuned sufficiently highly from the critical speed region, it is possible to allow the turbine rotor to operate safely and stably.

The nature and further characteristic features of the present invention will be made more clear from the following descriptions made with reference to the accompanying drawings.

DESCRIPTION OF THE PREFERRED EMBODIMENTS

Figure 1:
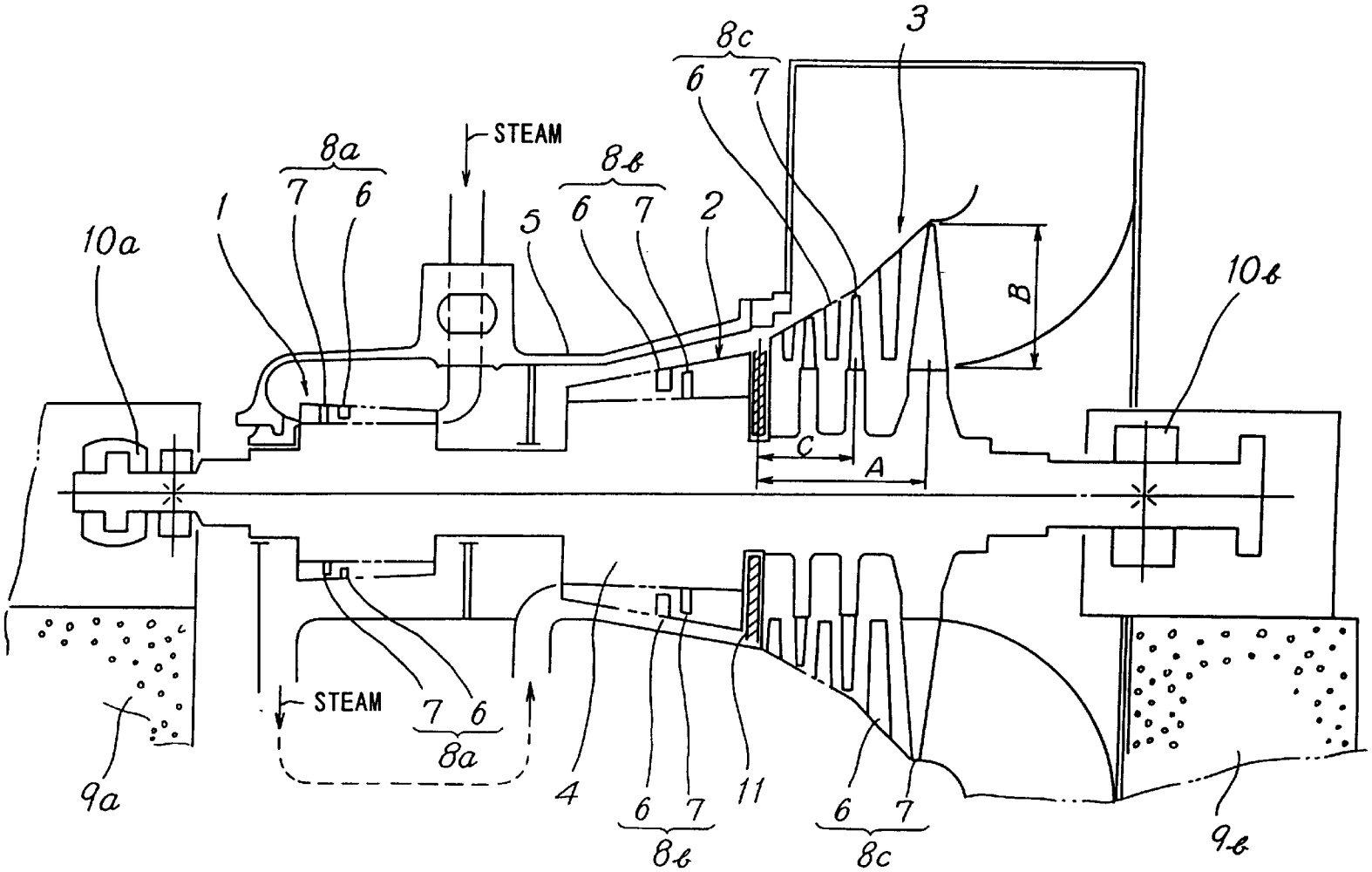
FIG. 1 is a schematic sectional view showing a first embodiment of a steam turbine according to the present invention.

Embodiments of steam turbines according to the present invention will be explained hereunder with A reference to the accompanying drawings and reference numerals or symbols shown in the drawings.

FIG. 1 is a schematic sectional view showing a first embodiment of a steam turbine of the present invention.

A steam turbine of the first embodiment is used in a combined cycle power plant having such main design points as that steam pressure is 100 kg/cm$^2$ or more, steam temperature is 500° C. or more, and a length of a turbine movable blade provided on a final stage of a low pressure portion of a turbine rotor is 30 inches or more.

The steam turbine of this embodiment employs a high-intermediate-low pressure integrated type structure for example. In this steam turbine, a turbine high pressure section 1, a turbine intermediate pressure section 2 and a turbine low pressure section 3 are combined together into one high-intermediate-low pressure integrated turbine rotor (turbine shaft) 4 and accommodated in a turbine casing 5.

The high-intermediate-low pressure integrated turbine rotor 4 comprises a high pressure turbine stage 8*a*, an intermediate pressure turbine stage 8*b* and a low pressure turbine stage 8*c* in which turbine nozzles 6 and turbine movable blades 7 are combined respectively in the turbine high pressure section 1, the turbine intermediate pressure section 2 and the turbine low pressure section 3. The high-intermediate-low pressure integrated turbine rotor 4 is of a so-called axial flow type in which a plurality of stages, i.e., the turbine stages 8*a*, 8*b* and 8*c* are formed along a direction of stream flow.

Opposite ends of the high-intermediate-low pressure integrated turbine rotor 4 are rotatably supported by bearings 10*a* and 10*b*, e.g., journal bearings mounted to bases 9*a* and 9*b*, respectively.

In the high-intermediate-low pressure integrated turbine rotor 4, in order that the turbine high pressure section 1 and the turbine intermediate pressure section 2 are provided with high temperature strength (creep strength) and the turbine low pressure section 3 is provided with room temperature strength (tensile strength) and high toughness, an insertion groove 11*a* for a partition plate 11, which is inserted when a so-called gradient thermal treatment in which quenching temperatures in respective portions are different is carried out, is provided in a boundary between the turbine intermediate pressure section 2 and the turbine low pressure section 3. In, the case of the high-low pressure integrated turbine rotor, the insertion groove 11*a* for the partition plate 11 is provided in a boundary between the turbine high pressure section 1 and the turbine low pressure section 3.

Figure 2:
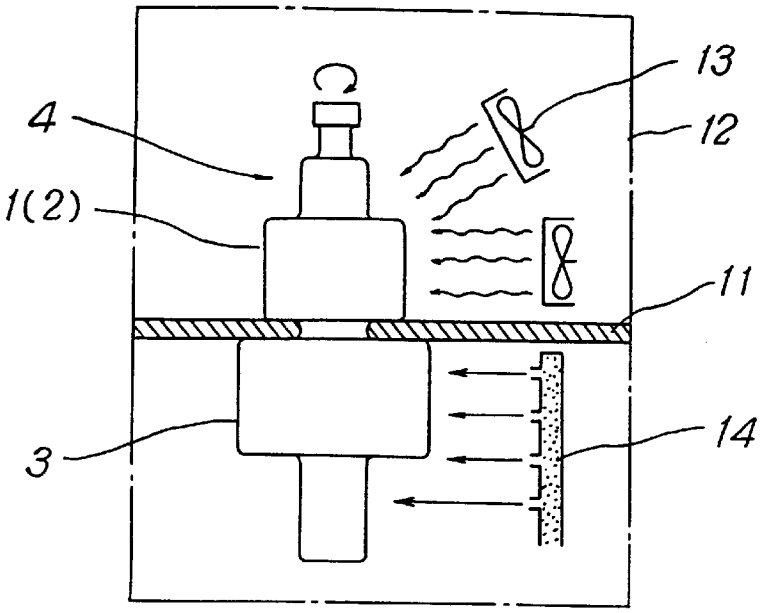
FIG. 2 is a schematic diagram for explaining gradient thermal treating means to be carried out for the steam turbine of the invention.

In gradient thermal treating means, as shown in Fig.2, a high-low pressure or high-intermediate-low pressure integrated turbine rotor 4 is accommodated in a thermal treating furnace 12 such as a vertical electric furnace, the partition plate 11 is provided in a boundary between the turbine intermediate pressure section 2 and the turbine low pressure section 3 (in the case of the high-low pressure integrated turbine rotor, the partition plate 11 is provided in a boundary between the turbine high pressure section 1 and the turbine low pressure section 3), the turbine high pressure section 1 and the turbine intermediate pressure section 2 are heated at a temperature of 955° C., for example, and the turbine low pressure section 3 is heated at 900° C., for example. Thereafter, the turbine high pressure section 1 and the turbine intermediate pressure section 2 are forcibly cooled by a fan 13 for relatively long time, and the turbine low pressure section 3 is cooled by spray water from a spray portion 14 swiftly.

Figure 3:
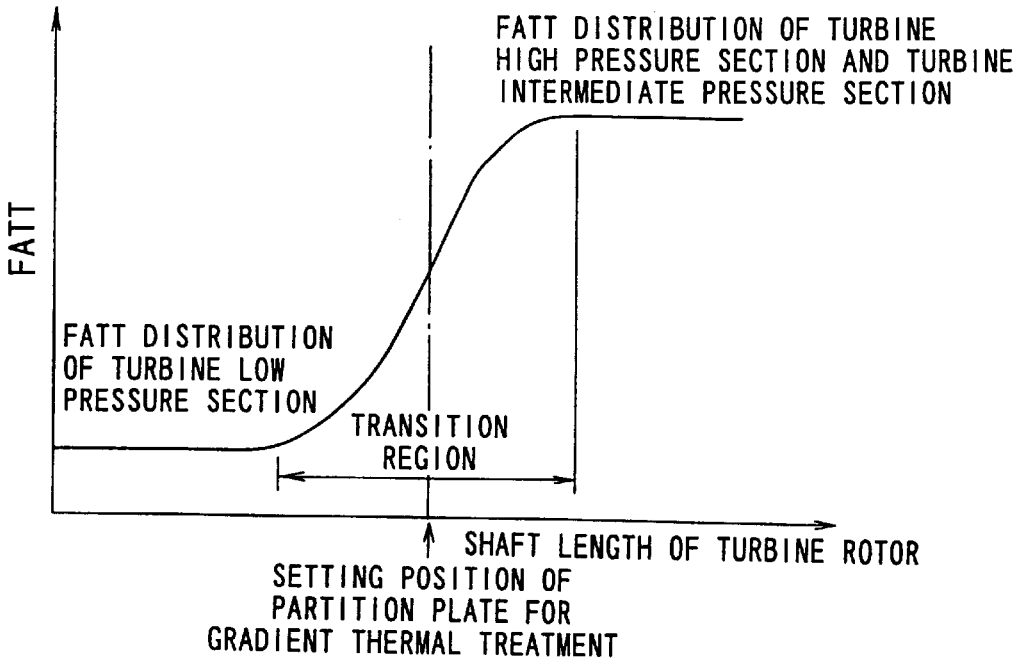
FIG. 3 is a graph showing FATT distribution in the vicinity of a partition plate disposed at the time of the gradient thermal treatment.

Meanwhile, in the case of the high-intermediate-low integrated turbine rotor 4 in which the turbine high pressure section 1 and the turbine intermediate pressure section 2 are gradient-heated at a temperature different from that of the turbine low pressure section 3 and after the gradient heating, these pressure sections are cooled at different speed, as shown in FIG. 3, a transition region is generated in an intermediate portion as a boundary of the partition plate 11 disposed for the gradient thermal treatment between a stable FATT value (Fracture Appearance Transition Temperature value) which is required for design on: the side of the turbine high pressure portion 1 and the turbine intermediate pressure section 2 and the stable FATT value which is required for design on the side of the turbine low pressure section 3. This transition region is a region where the room temperature strength (tensile strength) and the toughness are unstable as viewed from the turbine low pressure section 3, and the high temperature strength (creep strength) is unstable as viewed from the turbine high pressure section 1 and the turbine intermediate pressure section 2. For this reason, if the final low pressure turbine stage 8*c* in the turbine low pressure section 3 is disposed in this transition region, for example, the low pressure turbine stage 8*c* can not withstand a centrifugal force generated during the rotation of the turbine movable blade 7, and there is an anxiety that the high-intermediate-low integrated turbine rotor 4 is destroyed.

Figure 4:
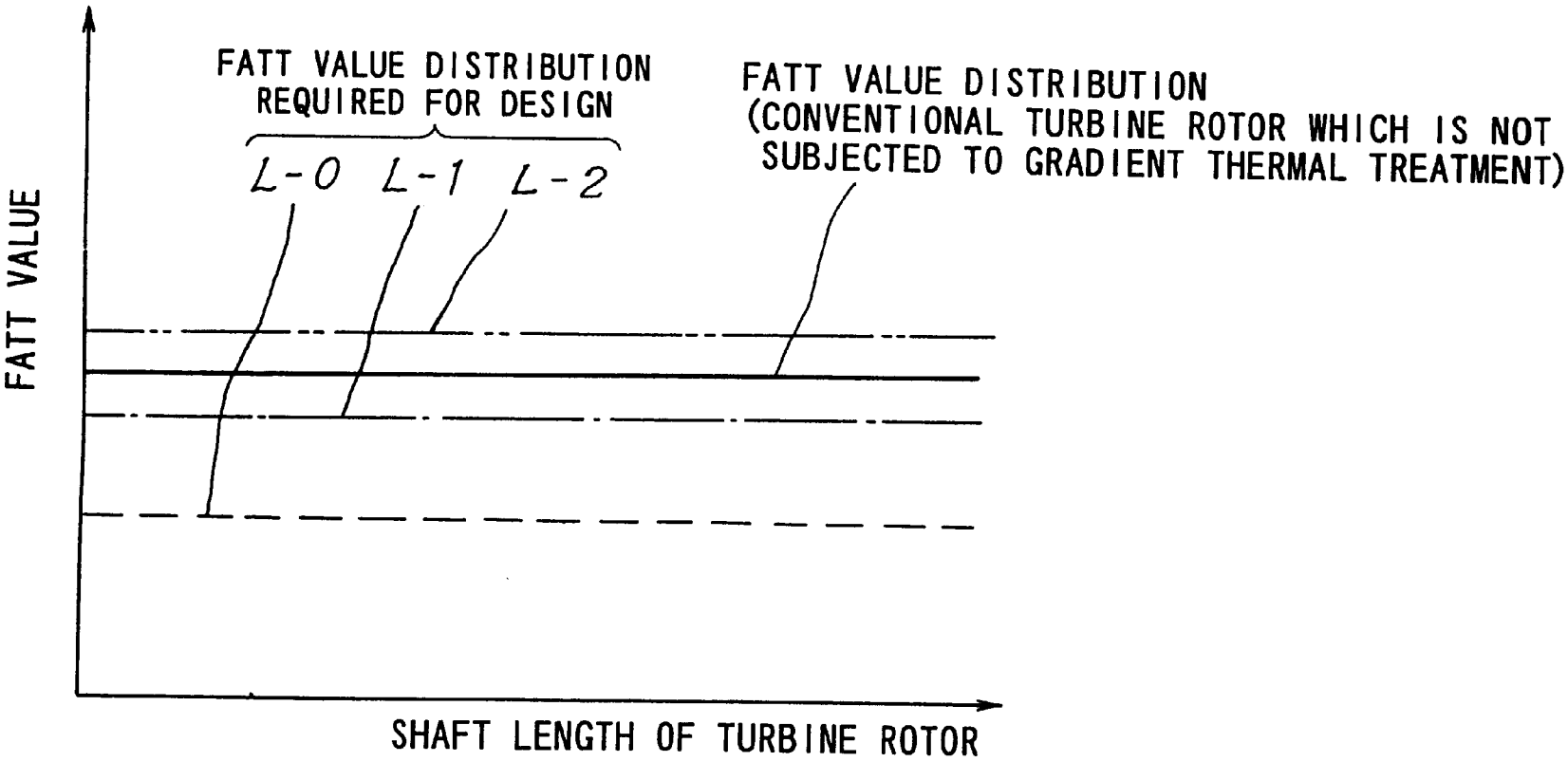
FIG. 4 is a graph showing FATT distribution of a conventional turbine rotor which is not subjected to the gradient thermal treatment.

Further, in the case of a turbine rotor which is not subjected to the gradient thermal treatment, as shown in FIG. 4 in which the vertical axis shows a FATT value and the horizontal axis shows a length of turbine rotor shaft, only the FATT value of the turbine rotor shown with a solid line is below the FATT value which is necessary for design of a low pressure turbine stage 8*c* (position L-2 or L-2 position, hereinafter) which is a third low pressure turbine stage 8*c* from the final stage of the turbine low pressure section 3 shown with a chain double-dashed line. Further, the FATT value which is necessary for design of a low pressure turbine stage 8*c* (position L-1 or L-1 position, hereinafter) which is a second low pressure turbine stage from the final stage of the turbine low pressure section 3 shown with a chain line and the FATT value which is necessary for design of a low pressure turbine stage 8*c* (position L-0 or L-0 position, hereinafter) which is the final stage of the turbine low pressure section 3 shown with a dashed line are both higher than the FATT value of the turbine rotor shown with the solid line. Therefore, if a length of the turbine movable blade 7 disposed in the position of L-1 or L-0 is as long as 30 inches or more, the turbine rotor can not withstand the centrifugal force of the turbine movable blade 7 generated during the rotation thereof, and there is a an anxiety that the turbine rotor is destroyed. The above point is taken into consideration in the present embodiment. Referring to FIG. 1, the turbine movable blade 7 disposed at the position L-0 is defined as a reference, an: axial direction from the reference turbine movable blade 7 to the insertion groove 11*a* for the partition plate is defined as A, a length of the turbine movable blade 7 at the position L-0 is defined as B, and an axial direction from the turbine movable blade 7 at the position L-1 to the partition plate 11 is defined as C. A ratio A/B of the axial distance A at the position L-0 and the blade length B at, the position L-0, and the axial distance C at the position L-1 are set in the following ranges:

$(A/B) \geqq 0.9$ $C \geqq 300$ mm

When the turbine rotor was designed, the FATT value at the position L-1 was taken as one design guideline and the axial distance C from the turbine movable blade 7 at the position L-1 to the partition plate 11 was set to be equal to or smaller than 300 mm, based on the following reasons:

That is, it is generally known that, in the high-intermediate-low integrated turbine rotor 4, a stress on a center portion thereof is as low as half or less of a bore stress of the turbine rotor having a center bore. In this case, it is known that a bore stress at the position L-0 is affected by a size of the turbine movable blade 7, but a bore stress at the position L-1 is maintained at a substantially constant value even if the length of the turbine movable blade 7 is as long as 30 inches or more. Further, since the steam design temperature is determined irrespective of the length of the turbine movable blade 7 at the position L-0, the FATT value required for design in the position L-1 is substantially constant irrespective of the length of the turbine movable blade 7 disposed at the position L-0.

Under such circumstances, in designing the high-intermediate-low integrated turbine rotor 4, the FATT value at the position L-1 is determined as a selection guideline for design.

Figure 5:
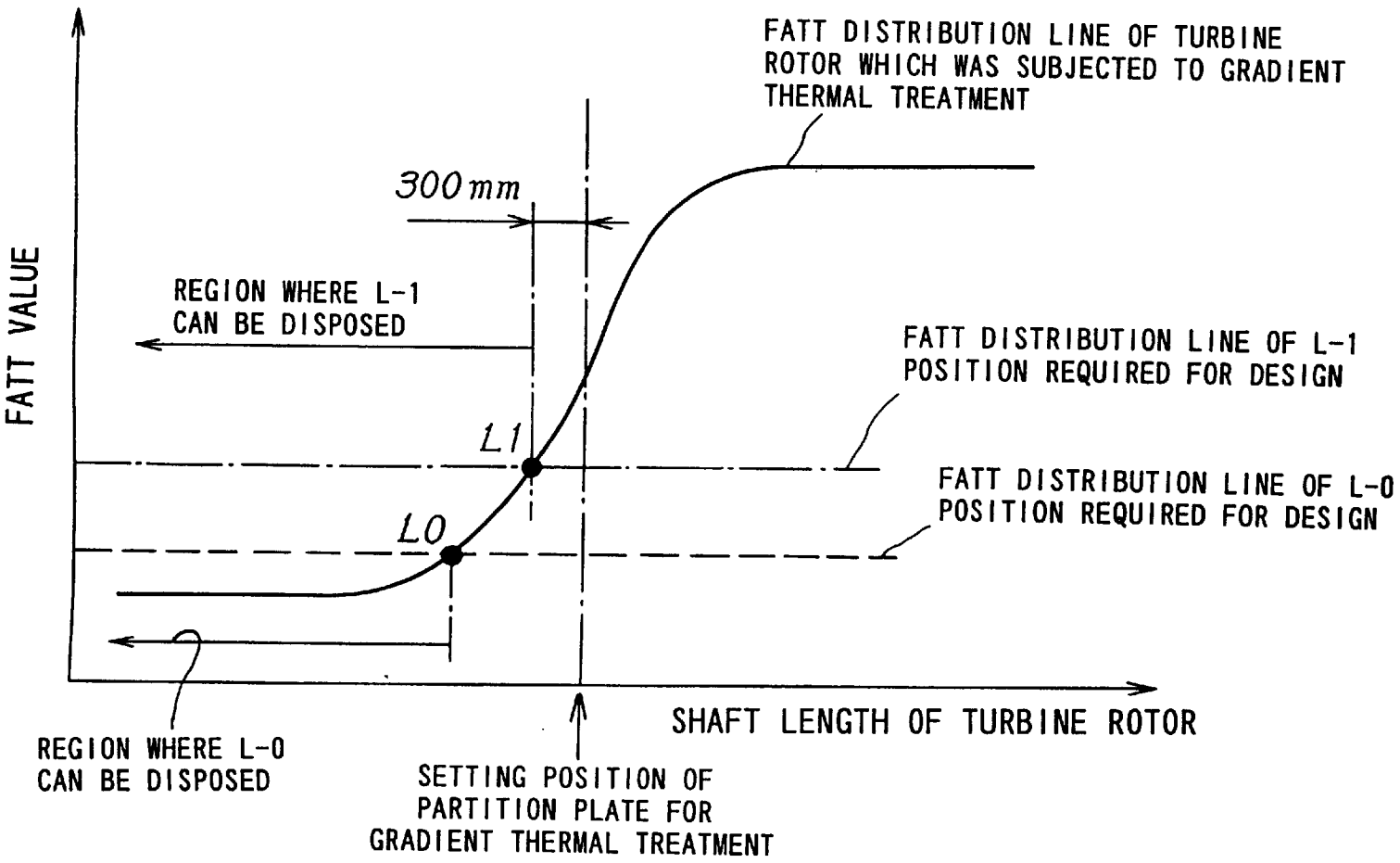
FIG. 5 is a graph showing FATT distribution for setting a necessary position for disposing the partition plate for the gradient thermal treatment from each of positions of L-1 and L-0 in the gradient thermal treating means carried out for the steam turbine of the invention.

As shown in FIG. 5, the turbine rotor which was subjected to the gradient thermal treatment is plotted such that the FATT distribution line is shown with a solid line, whereas, the FATT distribution line in the position L-1 which is required for design is shown with a chain line, and the FATT distribution line in the position L-0 which is required for design is shown with a broken line.

At that time, after a survey, it was found that a point of intersection L1 of an FATT distribution line in the position L-1 and an FATT distribution line of the turbine rotor, which was subjected to the gradient thermal treatment was 300 mm away from a position where the partition plate 11 for the gradient thermal treatment, was disposed.

Therefore, If an axial distance C of the position L-1 exceeds 300 mm from the position where the partition plate 11 for the gradient thermal treatment is disposed, the FATT value necessary for the design is reliably secured. Since an axial distance A of the position L-0 is determined by a distance from the partition plate to the location of the intersection point L0 of the FATT distribution line at the position L-0 and the FATT distribution line of the turbine rotor which was subjected to the gradient thermal treatment, the position L-0 may be disposed at the intersection point L1 away from the point of intersection L0.

Next, the ratio A/B of the L-0 axial distance and the length of blade at L-0 position is set to A/B≧0.9 based on the following reason.

Figure 6:
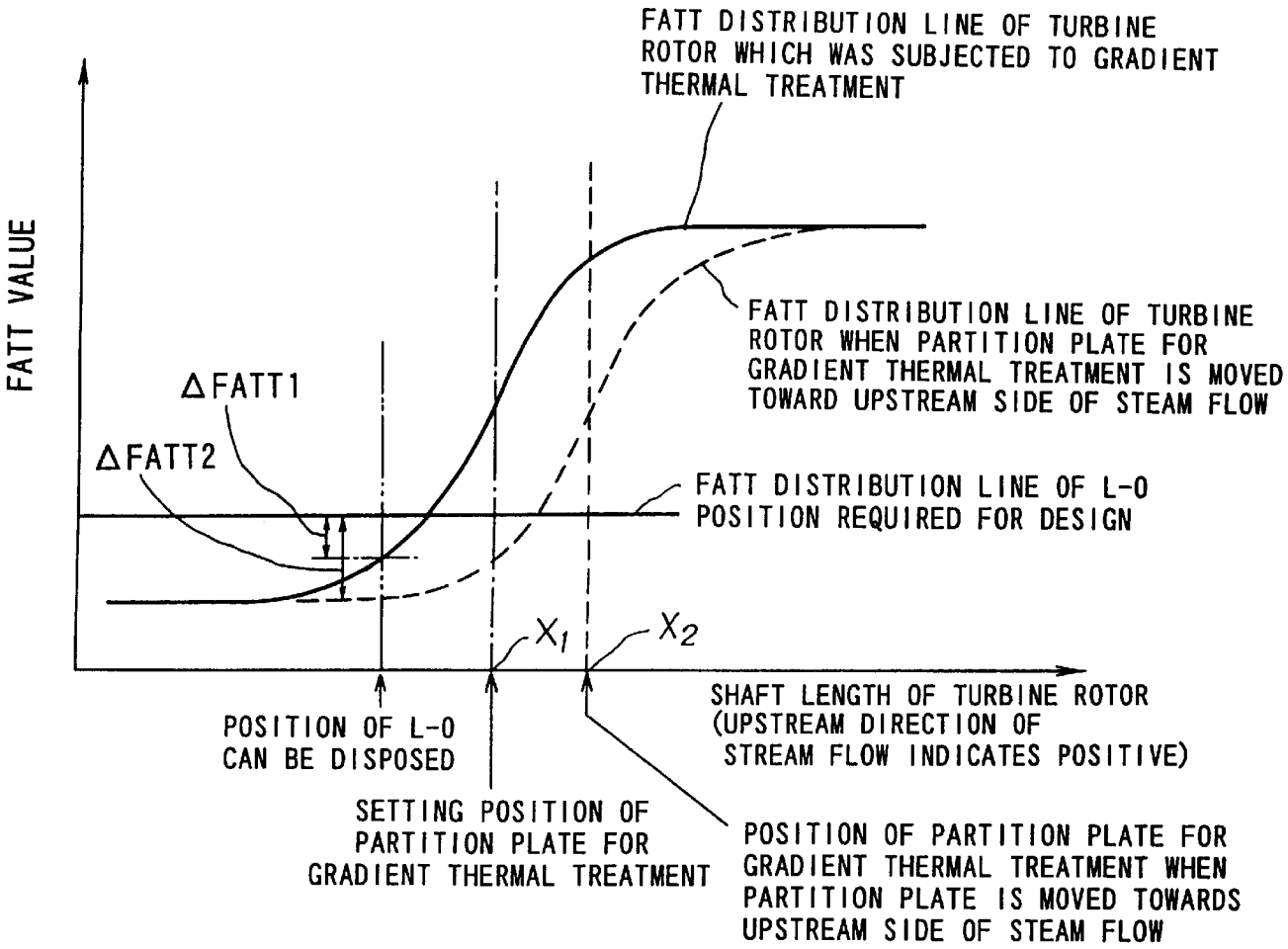
FIG. 6 is a graph showing FATT distribution for obtaining tolerance toughness difference in the position L-0 in the gradient thermal treating means carried out for the steam turbine of the invention.

The FATT distribution line of the turbine rotor which was subjected to the gradient thermal treatment and the FATT distribution line of L-0 position required for design are as shown in FIG. 6. In this case, a setting position of the partition plate 11 for the gradient thermal treatment is set to be a point X1 with respect to the L-0 position. At this time, allowable difference of the turbine low pressure section 3 at the position L-0 is Δ FATT1.

Here, the allowable difference A FATT of the turbine low pressure portion 3 in the L-0 position is defined by the following equation:

Δ FATT=(FATT value required for design in the L-0 position)−(actual FATT value in the L-0 position). In this definition equation, if the setting position of the partition plate 11 for the gradient thermal treatment is moved to the upstream side of the steam (turbine drive steam) from the point X1 towards the point X2 while taking the L-0 position as a reference, the FATT distribution line comes to a position shown with a broken line. The allowable difference of the turbine low pressure section 3 in the L-0 position at that time is Δ FATT2. It was confirmed that the allowable difference become greater as the setting position of the partition plate 11 was away from the L-0 position.

Figure 7:
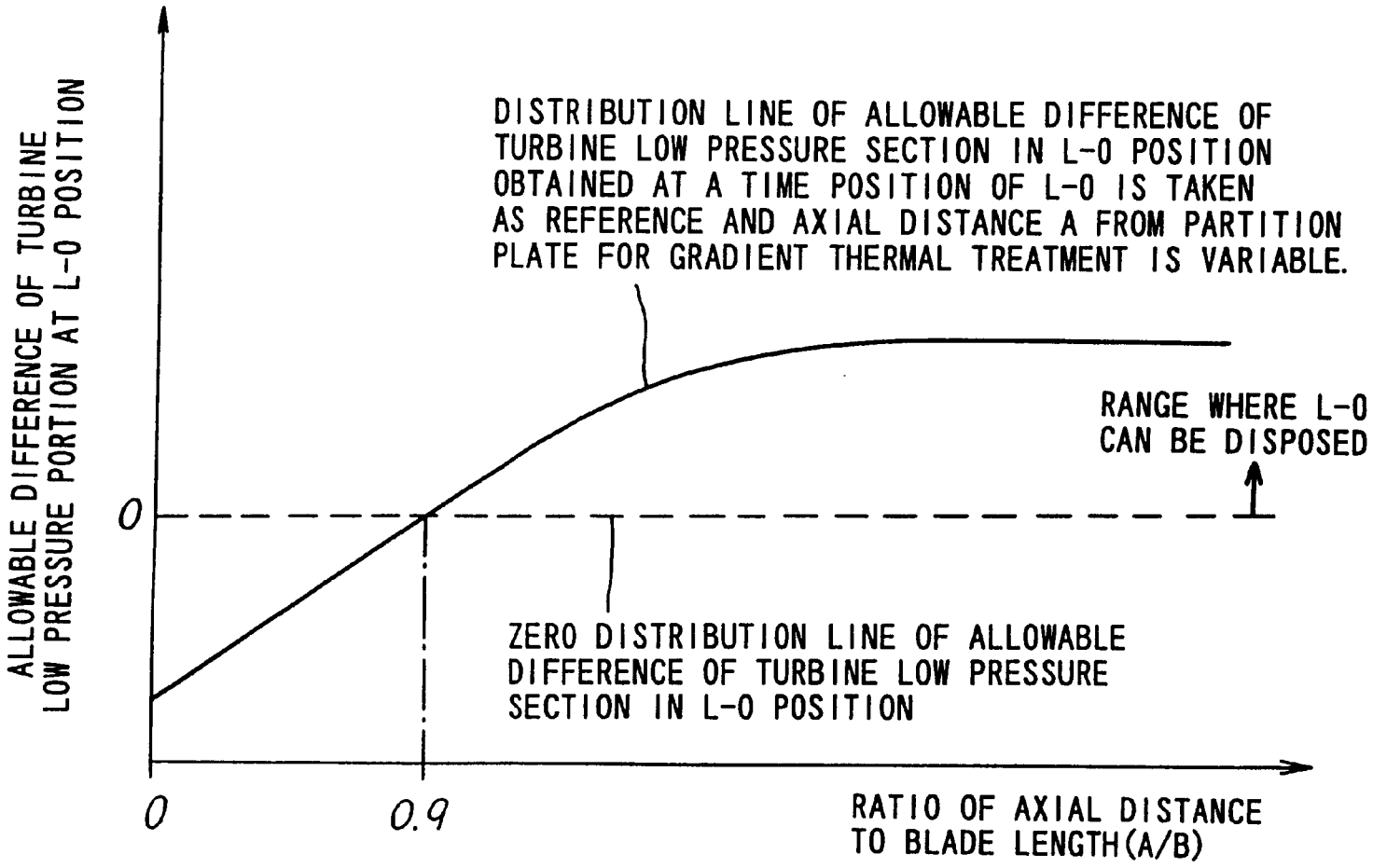
FIG. 7 is a graph showing toughness tolerance distribution for obtaining a ratio between an axial direction from the L-0 position to the partition plate for the gradient thermal treatment and a length of a turbine movable blade in the L-0 position.

The present embodiment focuses attention on the fact that as the setting position of the partition plate 11 was away from the L-0 position, the allowable difference become greater. In FIG. 7, the vertical axis shows a allowable difference value of the turbine low pressure section 3 in the L-0 position, and a horizontal axis shows a ratio (A/B) of the axial distance A from the L-0 position to the partition plate 11 and the blade length B. It was found that, if the allowable difference of the turbine low pressure portion 3 in the L-0 position obtained when the axial distance A was a variable was plotted, a distribution line was shown with a solid line. Since the allowable difference of the turbine low pressure section 3 in the L-0 position at that time was plotted and the distribution line was shown with a broken line, it was found that the ratio (A/B) of the axial distance A and the blade length B which was the point of intersection was 0.9, and it was a boundary point where the turbine movable blade 7 in the L-0 position could be disposed.

In this manner, in the described embodiment, since the ratio (A/B) of the axial distance A and the blade length B is set in a range of A/B≧0.9, it is possible to allow the high-intermediate-low integrated turbine rotor 4, which was subjected to the gradient thermal treatment, to operate safely and stably.

Figure 8:
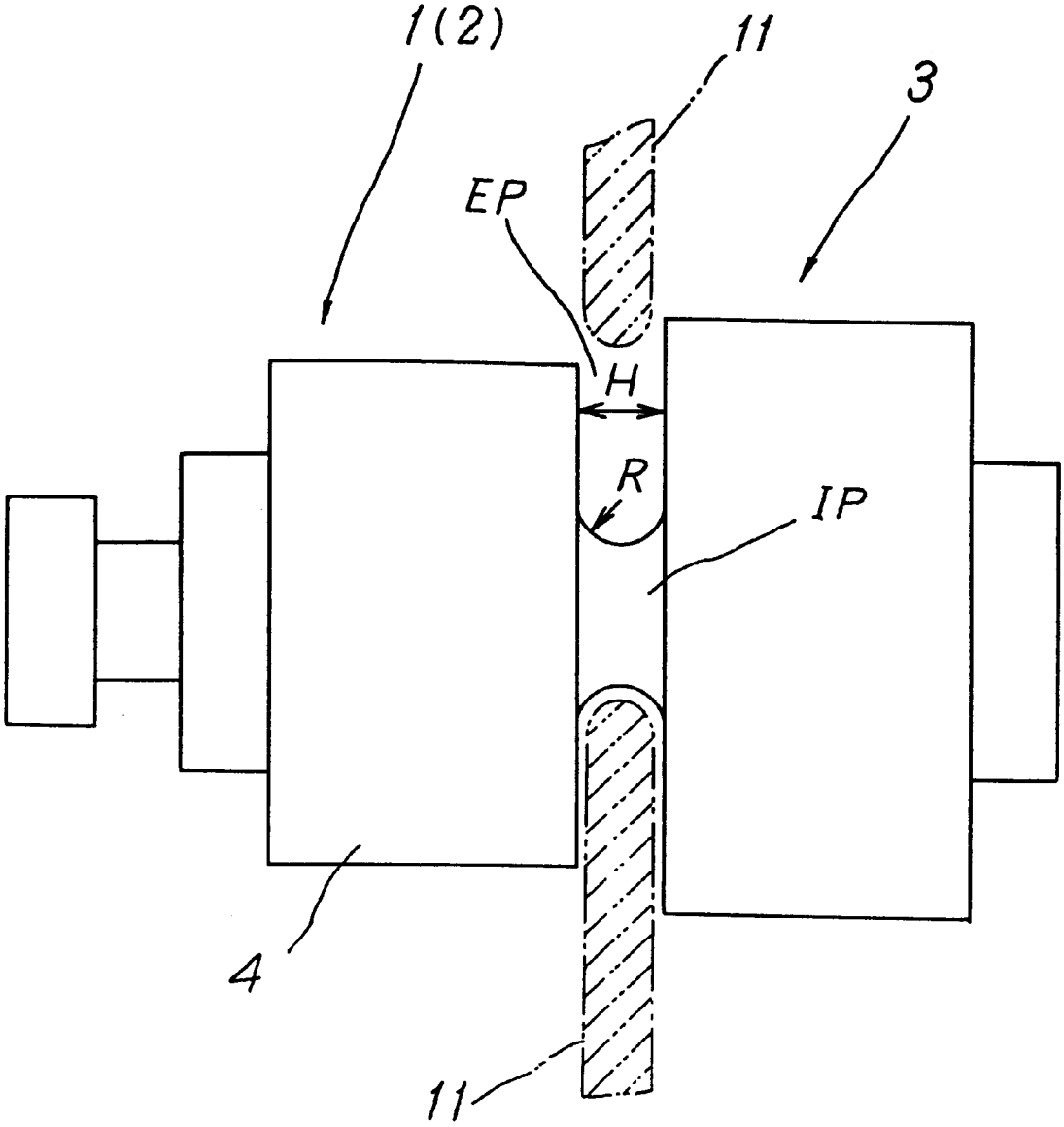
FIG. 8 is a schematic diagram showing a second embodiment of the steam turbine of the present invention.

FIG. 8 is a schematic diagram showing a second embodiment of the steam turbine of the present invention.

In the steam turbine according to the second embodiment, when the high-intermediate-low integrated turbine rotor 4 is subjected to the gradient thermal treatment, if a distance of a gap EP for accommodating the partition plate 11 for the gradient thermal treatment between the turbine low pressure section 3 and the turbine high pressure section 1 as well as the turbine intermediate pressure section 2 is defined as H and if a radius of curvature of a heat group of an intermediate portion IP, which connects the turbine intermediate pressure section 2 and the turbine low pressure section 3 with each other, is defined as R, H and R are set in the following ranges:

H≧140 mm

R≧70 mm

These numerical values are reasonable values capable of preventing quench crack at the time of the gradient thermal treatment from causing, and this was confirmed by experiment.

In the steam turbine according to the present embodiment, the gap EP in which the partition plate 11 for the gradient thermal treatment is accommodated is disposed at a position where the steam (turbine drive steam) temperature becomes 400° C. or less.

In the present embodiment, as described above, the distance H of the gap EP in which the partition plate 11 for the gradient thermal treatment is accommodated between the turbine intermediate pressure section 2 and the turbine low pressure section 3 is set in the range of H≧140 mm, the radius of curvature R of the heat group of the intermediate pressure portion IP, at which the turbine intermediate pressure section 2 and the turbine low pressure section 3 are connected to each other, is set in the range of R≧70 mm, and the gap EP in which the partition plate 11 for the gradient thermal treatment is accommodated is disposed at a position where the steam temperature becomes 400° C. or less. Therefore, it is possible to prevent the quench crack at the time of the gradient thermal treatment from causing, to suppress the stress concentration based on thermal stress generated during operation to a low value and to reliably provide the turbine high pressure section 1 and the turbine intermediate pressure section 2 with high temperature strength (creep strength) and provide the turbine low pressure section 3 with room temperature strength (tensile strength) and toughness.

Figure 9:
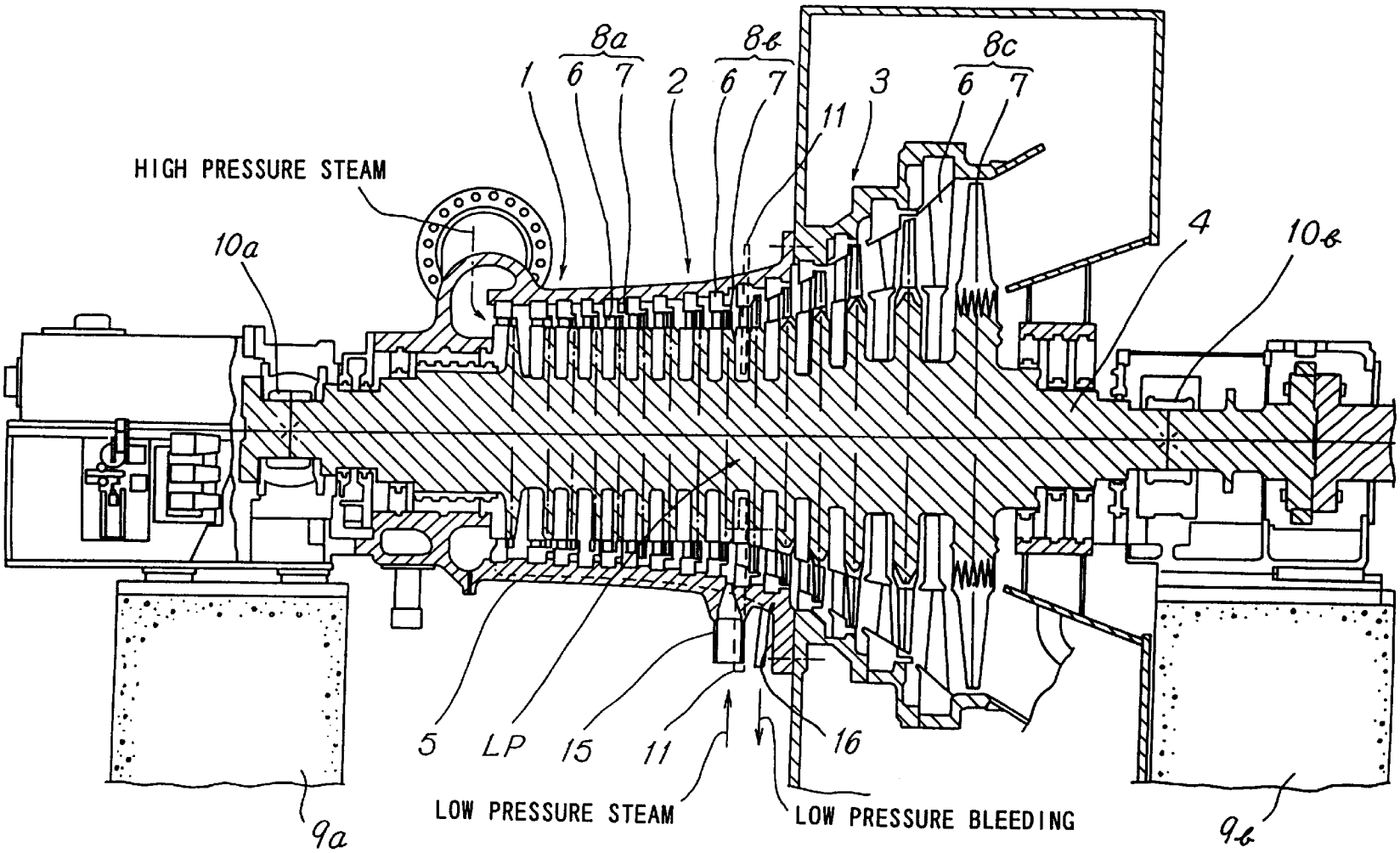
FIG. 9 is a schematic sectional view showing a third embodiment of the assembled steam turbine of the present invention.

FIG. 9 is a schematic sectional view showing a third embodiment of the assembled steam turbine of the invention. Constituent elements similar to those of the first embodiment are designated with the same reference numerals or symbols and overlapping explanation is omitted herein.

In the steam turbine of the third embodiment, any one of space regions LP of a low pressure steam inlet 15 and a low pressure bleeder (port) 16 of the turbine low pressure section 3 of the high-intermediate-low integrated turbine rotor 4 is utilized as a setting position of the partition plate 11 for the gradient thermal treatment.

Conventionally, since the setting position of the partition plate 11 for the gradient thermal treatment must be secured in the steam turbine, there is a tendency that a span between the bearings of the high-intermediate-low integrated turbine rotor 4 becomes long. However, in the conventional steam turbine, if the bearing span is made long, a critical speed region is reduced during the operation, and if a shaft vibration is increased by some reasons, the steam turbine is brought into a dangerous state.

This embodiment is made by taking this point into consideration and any one of space regions LP of the low pressure steam inlet 15 and the low pressure bleeder 16 in the turbine low pressure section 3 is utilized as the setting position of the partition plate 11 for the gradient thermal treatment, so that the bearing span is made relatively short.

Therefore, according to the present embodiment, since the bearing span of the high-intermediate-low integrated turbine rotor 4 is relatively short to increase the critical speed region, it is possible to sufficiently detune the rated operation number of the high-intermediate-low integrated turbine rotor from the critical speed region, and to stably operate the turbine.

Figure 10:
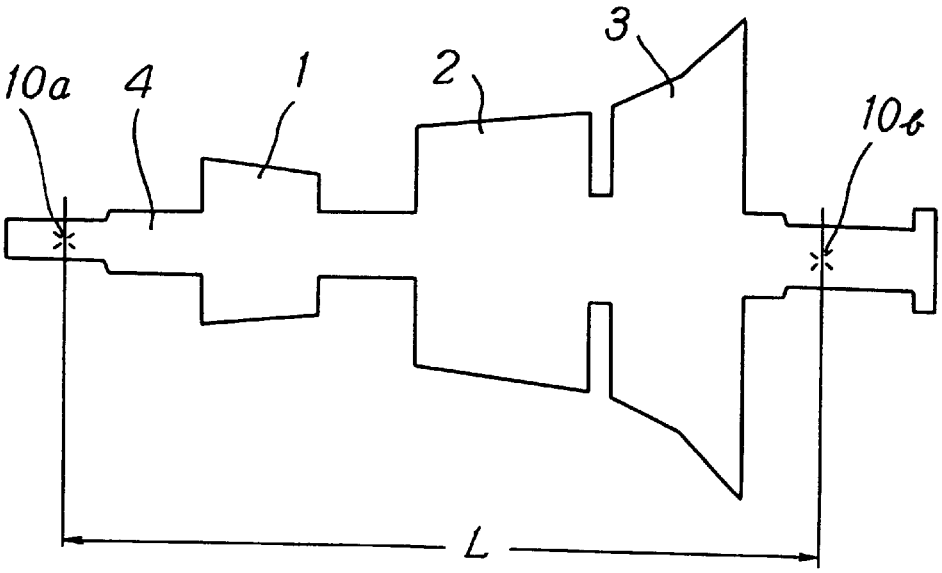
FIG. 10 is a schematic diagram showing a fourth embodiment of the steam turbine of the invention.

FIG. 10 is a schematic diagram showing a fourth embodiment of the steam turbine of the present invention. Constituent elements similar to those of the first embodiment are designated with the same reference numerals.

In the steam turbine of the fourth embodiment, the turbine high pressure section 1 and the turbine intermediate pressure portion 2 are subjected to the gradient thermal treatment at a temperature different from that of the turbine low pressure section 3. A bearing span L between bearings 10*a* and 10*b* of the high-intermediate-low integrated turbine rotor 4 is set in a range of $L \geqq 5{,}700$ mm.

In generally, if the bearing span L of the steam turbine is made long, the critical speed of the shafting will be reduced so that the speed approaches the rated rotation number, and the turbine is brought into a dangerous operation state.

Figure 11:
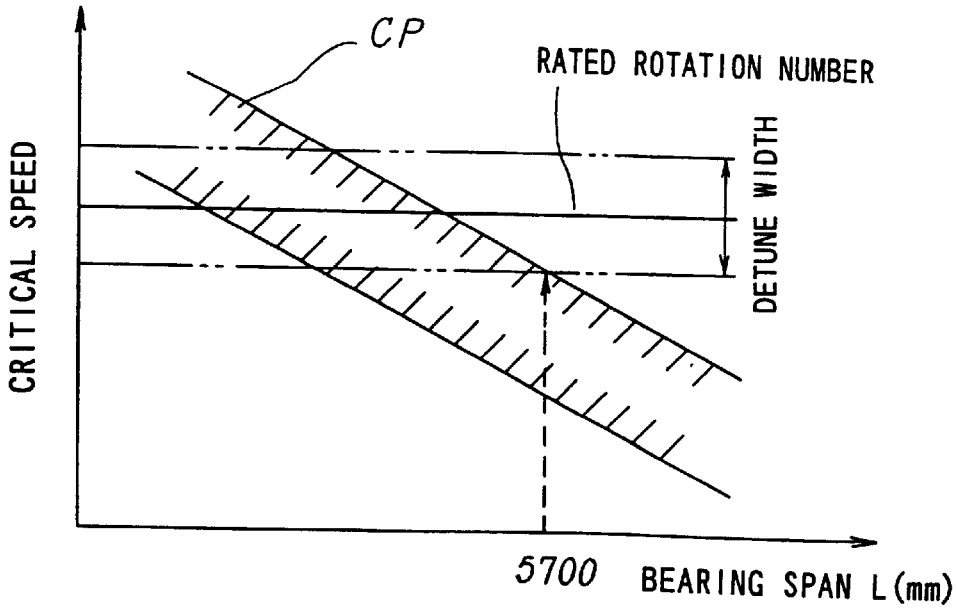
FIG. 11 is a graph of critical speed of a turbine rotor for showing the relation between a span between bearings and the critical speed.

The critical speed generated as the bearing span L becomes long is taken into consideration in the present embodiment, and as shown in FIG. 11, the bearing span L is set in the range of $L \geqq 5{,}700$ mm so that the rated rotation number can be detuned from the critical speed region CP shown with slopped lines.

In the present embodiment, as described above, since the bearing span L is set in the range of $L \geqq 5{,}700$ mm, it is possible to allow the high-intermediate-low integrated turbine rotor to operate safely and stably.

It is to be noted that the present invention is not limited to the described embodiments and many other changes and modifications may be made without departing from the scopes of the appended claims.

What is claimed is:

1. A steam turbine including a turbine high pressure section, a turbine intermediate pressure section and a turbine low pressure section, in which at least two or more of said pressure sections are combined together, and a turbine rotor which is subjected to a gradient thermal treatment at different thermal treating temperatures at respective pressure sections and has a distribution of FATT (Fracture Appearance Transition Temperature) value in an axial direction thereof is rotatably supported by bearings and accommodated in a turbine casing, wherein in a case where an axial distance from a setting position of a turbine movable blade of a final stage of the turbine low pressure section to a setting position of a partition plate disposed at a time when the gradient thermal treatment is performed to each of the pressure sections at different thermal treating temperature at which the FATT value distribution is caused to the turbine rotor is defined as A in which the FATT value is sharply lowered from the high pressure section towards the low pressure section and a transition region is formed in front and rear side area of the partition plate, a blade length of the turbine movable blade is defined as B, and an axial distance from a prior stage of the final stage of the turbine low pressure section to the setting position of the partition plate is defined as C, the setting position of the partition plate is set in a range of $(A/B) \geqq 0.9$ and $C \geqq 300$ mm.

2. A steam turbine according to claim 1, in a case where a gap of the turbine rotor in which the partition plate is disposed is defined as H and a radius of curvature of a groove bottom of the gap is defined as R, said gap H and said radius R of curvature of the groove bottom are set in ranges of $H \geqq 140$ mm and $R \geqq 70$ mm.

3. A steam turbine according to claim 1, wherein said partition plate is disposed at a position at which a steam temperature is 400° C. or less.

4. A steam turbine according to claim 1, wherein said partition plate is disposed at a position of either one of space regions of a low pressure steam inlet and a low pressure bleeder port of the turbine low pressure section.

5. A steam turbine according to claim 1, wherein in a case where a bearing span of said turbine rotor is defined as L, the bearing span L is set in a range of $L \geqq 5{,}700$ mm.

6. A steam turbine according to claim 1, wherein a blade length of the turbine movable blade in the final stage of the turbine low pressure section is 30 inches or more.

7. A steam turbine according to claim 1, wherein at least one of said turbine pressure sections is supplied with a steam having pressure of 100 kg/cm$^2$ or more and temperature of 500° C.

* * * * *